United States Patent [19]

Martin

[11] Patent Number: 4,518,100

[45] Date of Patent: May 21, 1985

[54] NEWSPAPER DISPENSING MACHINE

[76] Inventor: George E. Martin, 14131 - 76th Ave., Surrey, British Columbia, Canada

[21] Appl. No.: 450,993

[22] Filed: Dec. 20, 1982

[51] Int. Cl.[3] ..... B65H 3/24

[52] U.S. Cl. ..... 221/225; 221/227

[58] Field of Search ..... 221/251, 231, 224–227; 271/166, 149, 150, 126, 129, 30 A, 22, 24, 25; 414/330, 103, 107

[56] References Cited

U.S. PATENT DOCUMENTS

| | | | |
|---|---|---|---|
| 1,662,329 | 3/1928 | Peterson . | |
| 2,396,411 | 3/1946 | Cameron . | |
| 3,062,406 | 11/1962 | Kent et al. . | |
| 3,104,781 | 9/1963 | Clift . | |
| 3,685,691 | 9/1972 | Charest et al. . | |
| 4,273,322 | 6/1981 | Ginther, Sr. et al. | 271/149 |

*Primary Examiner*—Stanley H. Tollberg

[57] ABSTRACT

A newspaper vending machine having a plurality of inclined slides mounted so that their top surfaces lie in a common plane and a plurality of friction belts, one between each pair of slides. The slides have a low coefficient of friction with paper while the friction belts have a high coefficient of friction with paper. The friction belts are movable from a normal position below the top surfaces of the slides to an elevated position above the latter surfaces and slightly rearwardly of their normal position. A pressure plate biases a vertical stack of newspapers positioned on the slides in a downward direction along the slides toward a discharge chute. Transporting structure is located between the discharge chute and the slides for engaging the bottom edge of the leading newspaper and removing the newspaper to and discharging it into the discharge chute. Moving structure is provided for moving the friction belts to an elevated position such that the top surfaces of the belts are below the bottom edge of the leading newspaper.

20 Claims, 6 Drawing Figures

NEWSPAPER DISPENSING MACHINE

BACKGROUND OF THE INVENTION

The present invention relates to a machine for vending newspapers, magazines or similar material automatically in response to insertion of a coin into an associated coin operated control mechanism.

Conventional coin operated newspaper vending machines have a locked access door which is openable in response to insertion of a coin into a coin operated control mechanism. Opening of the access door provides the user with access to the entire stack of newspapers. To avoid loss through users who take more than one paper after paying for only one, machines which discharge one newspaper or magazine at a time were developed. One such device disclosed in U.S. Pat. No. 1,662,329 issued to Peterson utilizes a gravity operated conveyor and a plurality of upwardly projecting pins to move a vertical stack of papers forwardly and downwardly towards an abutment. A hand operated crank and lever mechanism picks up the folded edge of the leading newspaper and drops it into a tray. No mechanism is provided for relieving the pressure of the preceding newspapers during operation of the crank so that for thin newspapers in can happen that two will be discharged rather than one. In addition, the conveyor is subject to jamming and binding since it is merely gravity operated.

U.S. Pat. No. 3,104,781 issued to Clift utilizes a cam operated bevelled flange and a set of needles to eject the leading newspaper from a vertical stack of newspapers. The newspapers are subject to tearing of their folded edge by the needles during release. In addition, the flange mechanism has no means of adjustment to adapt to varying thicknesses of newspapers.

U.S. Pat. No. 2,396,411 issued to Cameron illustrates the use of a plurality of arms fixedly attached to a rotatable shaft and movable through notches in an inclined newspaper support plate.

Arcuate portions of the arms behind recessed faces thereon are used to keep the succeeding papers from advancing during forward rotation of the arms and return movement thereof. Cameron preferably employs needle points at the end of the arms to ensure a positive grip on the leading paper. With the needle points the Cameron device requires critical adjustment to newspaper thickness in order to avoid scraping and tearing the second frontmost newspaper as proper operation requires the arm and needles to be inserted precisely between the latter newspaper and the frontmost one. Moreover, a relatively small deviation in adjustment can result in the discharge of two newspapers rather than one with or without the needle points.

A more important problem with using arcuate portions to restrain succeeding newspapers arises when large stacks of thin newspapers are in place. In the latter case, the pressure on the front papers in the stack results in the arcuate arm picking up more than one newspaper. Additionally with freshly printed limp newspapers the sloping shoulder used by Cameron to stop forward movement of the newspapers causes the front one to buckle frontwardly and become jammed upon lifting by the arm.

SUMMARY OF THE INVENTION

According to the invention there is provided a newspaper dispensing machine which includes a frame, a slide means mounted on the frame for supporting a vertically orientated stack of newspapers whose folded edges face downwardly the slide means having a discharge end and a pressure plate means mounted on the frame for biasing the vertically orientated stack of newspapers toward the discharge end. A discharge chute is located proximate the discharge end of the slide means. Transporting means are mounted on the frame proximate the discharge end of the slide means having a lip means for engaging the folded edge of the leading newspaper in the stack of newspapers at the discharge end. Friction belt means are mounted on the frame having an upper newspaper contacting surface with a high co-efficient of friction with paper and being reversibly movable from a retracted position spaced apart from the folded edges of a stack of newspapers to an extended position abutting the folded edges of the newspapers and slightly upwardly and rearwardly of the retracted position. Moving means are mounted on the frame and coupled to the latter from the retracted position to the extended position. The moving means are also coupled to the transporting means first raises the leading newspaper above a notional plane defined by the folded edges of the remaining newspapers in the stack then the friction belt means moves from the retracted position to the extended position raising the remaining newspapers in the stack and moving them away slightly from the leading newspaper to relieve pressure on the latter. Then the moving means moves the leading newspaper to and discharges it into the discharge chute.

Advantageously, the transporting means includes a rotating means having a notch parallel to the stack of newspapers for engaging the bottom edge of the leading newspaper thereof and rotatable so as to move the leading newspaper to and release it into the discharge chute.

The transporting means may be a plurality of the spaced apart wheels mounted on a tumble shaft and having a plurality of aligned notches such that each notch in a set of aligned notches has the same depth but the depth of the notches in different sets of aligned notches varies so as to accomodate different thinknesses of newspapers. Further included is adjustment means for positioning each set of aligned notches in an operating position proximate the leading newspaper in the stack of newspapers.

The use of friction belts to remove pressure against the leading newspaper during its removal from the stack and subsequent discharge avoids problems in previous machines which result in accidental discharge of more than one newspaper or other causes of inoperability such as failure to discharge a newspaper or jamming of the discharged newspaper.

BRIEF DESCRIPTION OF THE DRAWINGS

In drawings of preferred embodiments of the invention.

DETAILED DESCRIPTION WITH REFERENCE TO THE DRAWINGS

Figure 1:
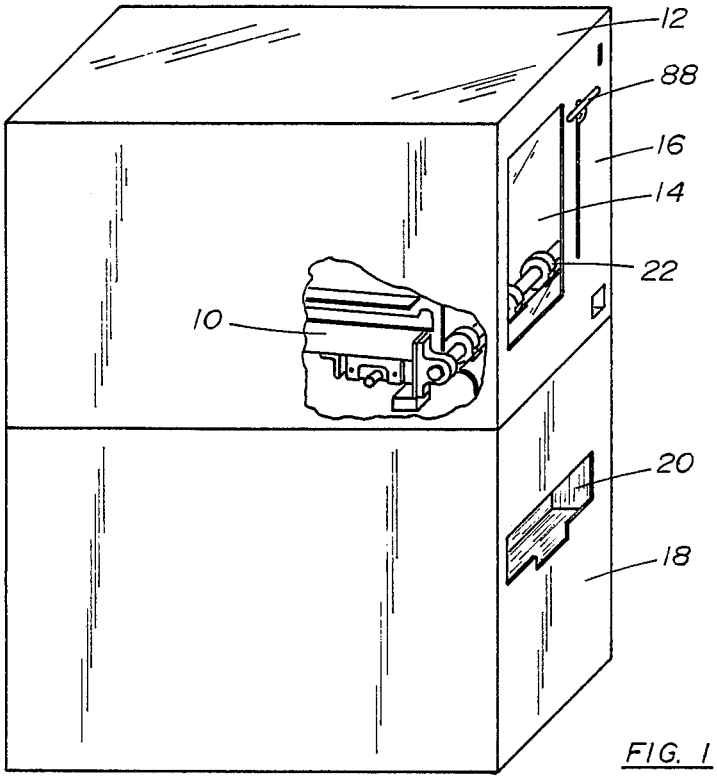
FIG. 1 is a perspective view of the newspaper vending machine, mounted on a stand.

A preferred embodiment of the newspaper vending machine illustrated in FIG. 1 includes the frame 10 and associated operating mechanism enclosed within a housing 12. Both the frame 10 and housing are supported by a stand 18. A coin receiving mechanism 16 is attached on one side of the frame 10. A newspaper catch plate 20 mounted on the front of the stand 18 and catches each newspaper as it is discharged. A viewing window 14 allows the user to inspect the interior to see when the machine has no newspapers left.

Figure 2:
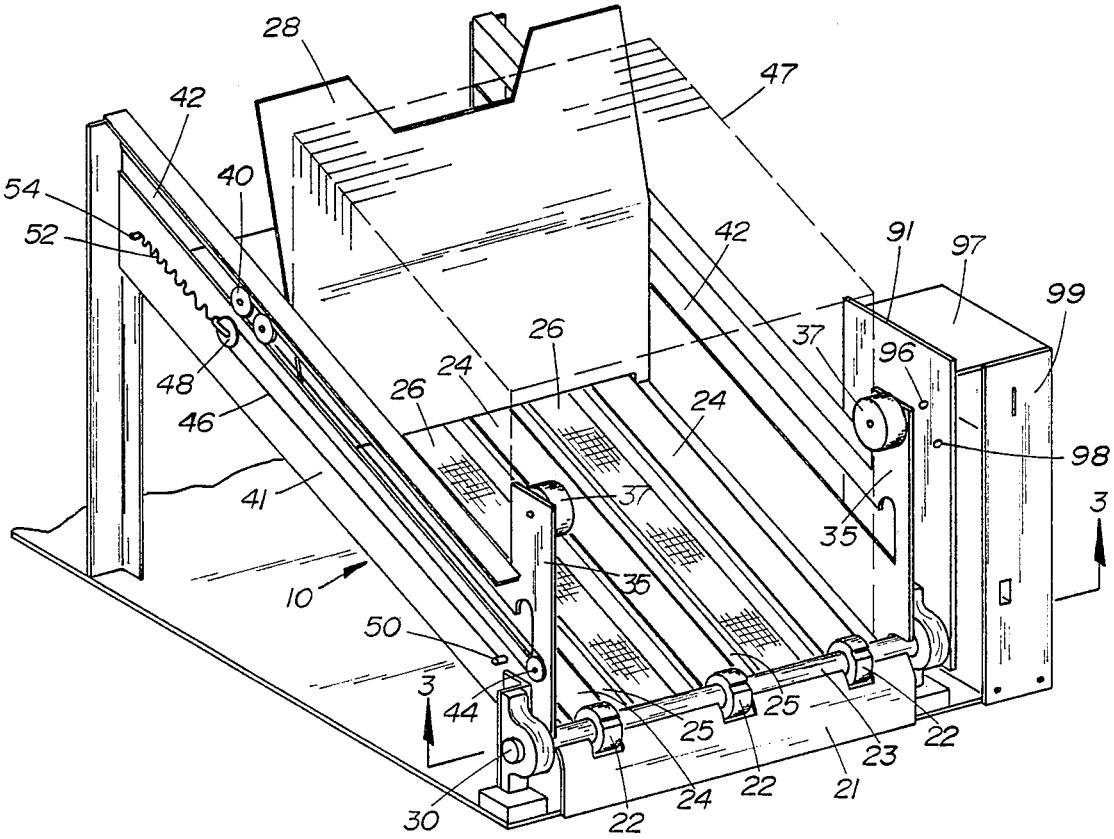
FIG. 2 is a perspective view of the newspaper vending machine with its outer cover removed.
Figure 6:
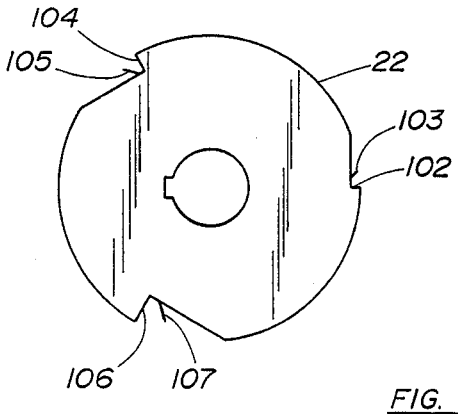
FIG. 6 is an elevation view of a notched wheel.

The frame 10 and associated operating mechanism with the housing 12 removed is illustrated in FIG. 2. A bottom support is provided by three elongated teflon slides 24 whose top surfaces lie in a common plane and which are inclined at a sufficiently large angle to the horizontal to allow gravity in combination with a slight force to move a vertical stack of newspapers 47 downwardly along the slides 24. At the lower end of the slides 24 and mounted transversely thereto in a pair of bearings 30 is a tumble shaft 23. Affixed to the tumble shaft 23 are three spaced apart notched wheels 22. Each wheel 22 has three notches with each notch spaced 120° from the other two and each notch being of a different depth than the other two (see FIG. 6). Notch depths of 0.078 inches, 0.140 inches and 0.188 inches have been selected to accommodate a typically encountered range of newspaper thicknesses. Clearly, other depths may be required for newspapers or magazines which have significantly different thicknesses. Notches of the same depth in each of the three wheels 22 are aligned. In each notch 102, 104 and 106 there is a small pin 103, 105 and 107, respectively. Above the tumble shaft 23 at either end thereof there is rotatably attached to two upwardly extending tongue portions 35 of the frame 10, respective wheels 37 for contacting the leading newspaper of a stack of newspapers. Each of the slides 24 extends around either side of respective wheels 22 a sufficient distance to avoid newspapers from jamming between a lower end of the slides and the notched wheels.

Positioned over the slides 24 is a substantially vertical pressure plate 28 mounted on a cross bar (not shown) which in turn, is connected at either end to a carriage mounted on a pair rollers 40 moveable along an elongated slot 42 in each vertical sidewall 41 of frame 10. Plate 28 is urged downwardly towards tumble shaft 23 by a tension assembly on each side of frame 10 which includes a fixed pulley 44 attached to side wall 41 proximate the tumble shaft 23, a movable pulley 48 coupled by coil spring 52 to a post 54 at the rear of side wall 41 and a fixed post 50 proximate the front of side wall 41 to which one end of cord 46 is tied. The other end of cord 46 passes over movable pulley 48, fixed pulley 44 and attaches to the carriage roller assembly 40. In the foregoing tensioning arrangement rollers 40 travel twice the distance of pulley 48 so that unacceptably large displacements of spring 52 are avoided.

Figure 3:
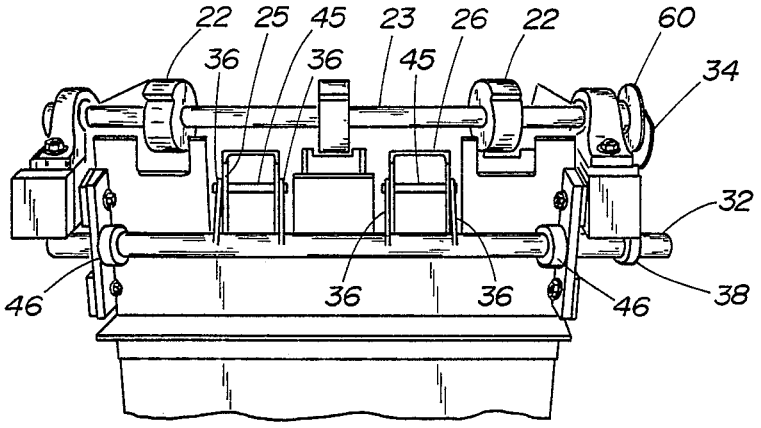
FIG. 3 is a perspective view of the bottom of the newspaper vending machine with the bottom plate removed.

Intermediate slides 24 are friction strips 26 normally positioned slightly below the level of the top surfaces of the slides 24 and inclined at substantially the same angle to the horizontal. The strips 26 are each mounted on the back surface of an elongated channel 25. The channels merely rest atop frame 10 and are not attached thereto. Across the sidewalls of each channel 25 at the lower end is rigidly affixed a rod 45 (see FIG. 3).

A pair of lugs 36 are rigidly affixed at one end to a rocker shaft 32 and are journalled at the other end to rod 45 adjacent each corresponding wall of the channel 25. Rocker shaft 32 is rotatably mounted in bearings 46 which are affixed to the frame 10.

Figure 4:
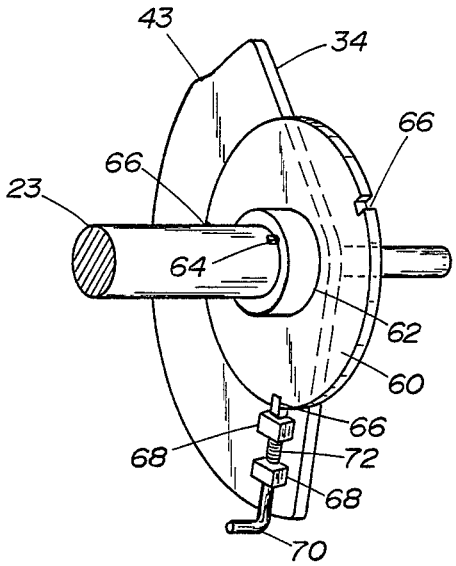
FIG. 4 is a perspective view of the tumble shaft and tumble shaft locking plate mounted on the tumble shaft.

As illustrated in FIG. 4 to one end of tumbler shaft 23 there is rotatably mounted a cam 34. Adjacent the cam 34 there is an adjustment plate 60 having 3 slots 66 in its periphery radially spaced apart 120° from each other. Affixed to the plate 60 is a cylindrical collar 62 locked to shaft 23 by a key 64 lodged in aligned keyways in the collar 62 and shaft 23. A locking rod 70 is slidable positioned in mating holes in a pair of spaced apart brackets 68 and 69 welded to a face of the cam 34 proximate the periphery of plate 60. A coil spring 72 acting in compression against one of the brackets 68 and a stop on the rod 70 urges the rod 70 towards the periphery of plate 60. With one of the slots 66 juxtaposed to rod 70, the latter snaps into the slot 66 and locks cam 34 to plate 60 and hence to tumble shaft 23.

Figure 5:
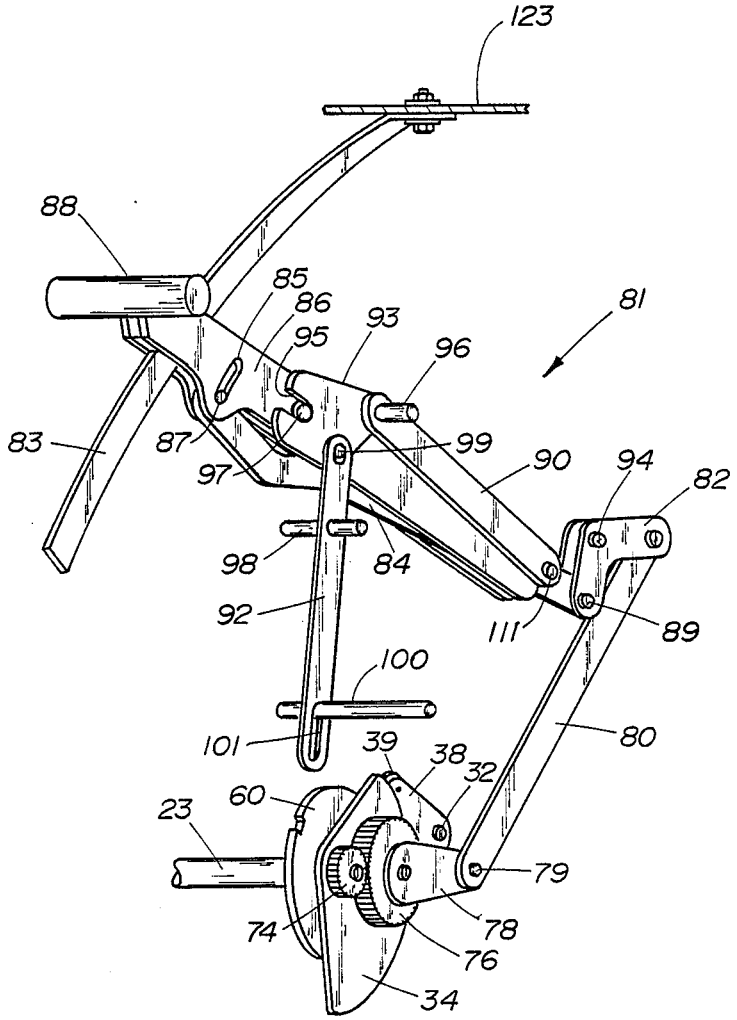
FIG. 5 is a perspective view of the coin controlled handle linkage mechanism for dispensing newspapers.

As illustrated in FIG. 5 a cam follower 38 is affixed to an end of rocker shaft 32 and has a rotatably mounted wheel 29 at the distal end thereof which rolls along shaped peripheral portion 43 (see FIG. 4) of cam 34. As cam 34 rotates in a counterclockwise direction, cam follower 38 rotates in a clockwise direction as does rocker shaft 32 affixed thereto.

On the side of cam 34 opposite to plate 60 there is rotatably affixed to the end of tumble shaft 23 a driven gear 74 attached to cam 34 which meshes with a driven gear 76. Affixed to driving gear 76 is a link member 78 which also couples by means of a pin 79 to an elongated link rod 80 such that the latter is rotatable about pin 79. The other end of link rod 80 is coupled to a coin controlled handle linkage assembly 81.

Assembly 81 consists of a handle 88 affixed to an end of a pair of handle members 86. Slidable within a slot in handle members 86 is an arcuate guide 83. Linkage arms 90, 92 and 84 and link plate 82 operating around fixed pins 94, 96 and 98 and in response to downward arcuate movement of handle 88 as constrained by guide 83 cause link rod 80 to move toward cam 34 and rotate gear 76 in a clockwise direction. Clockwise rotation of driving gear 76 results in counterclockwise rotation of driven gear 74, cam 34 and shaft 23. Latch rod 100, however, is normally locked in position thereby preventing movement of handle 88. Upon insertion of a suitable coin into a coin slot in the front plate 99 of the coin mechanism 16 latch rod 100 becomes movable thereby freeing handle 88 to move downwardly. Assembly 81 is housed adjacent a vertical plate 91 affixed to frame 10 by means of pins 96 and 98 journalled in pin holes in plate 91 and a corresponding side of the coin mechanism 16. Guide 83 is affixed to its top to an L-shaped plate 123 and at its bottom to bottom plate 21.

Spaced apart handle members 86 have an arcuate slot 85 proximate the handle end thereof in which there is freely slidable a pin 87. An operating link 84 is pivotally coupled to pin 87 at one end to a pin 89 on link plate 82. Handle members 86 are also pivotally coupled to pin 111. Pivotally coupled to a fixed pin 96 of the locking plate 93 having an open slot 95 which engages the pin 97 affixed to one of the handle members 86. A trajectory limiting member 90 is pivotally coupled at one end to fixed pin 96 and at the other end to pin 111. Engaging a fixed pin 99 on locking plate 93 is a locking arm 92 pivotal about a fixed pin 98 and having an elongated slot 101 at the opposite end which slidably engages the latch rod 100.

Pivotally coupled to the link plate 82 is an actuating rod 80 which constitutes the output from the linkage assembly 81. Initially handle members 86 are prevented from downward pivotal movement by the action of latch 100 locking arm 92 which in turn locks locking plate 93 and hence handle members 86 by means of pin 97. When the latch 100 is released, locking arm 92 is free to move downwardly, thereby allowing handle members 86 to pivot downwardly. As locking plate 93 is pivoted about fixed pin 96 it eventually disengages from pin 97. As handle members 86 pivot downwardly their trajectory is controlled by trajectory limiting arm 90 also coupled to the fixed pin 96 which causes handle members 86 to pivot link plate 82 about fixed pin 94 causing corresponding movement of actuating arm 80. Considering that the line joining fixed pin 94 and pin 89 is substantially perpendicular to the line of action on link plate 82 of operating link 84 the assembly of FIG. 5 results in a high initial torque being exerted on link plate 82.

Counterclockwise rotation of driven cam gear 74 results in clockwise rotation of rocker shaft 32 in response to movement of cam follower 38 on cam 34.

In operation a vertically oriented stack of newspapers is placed on slides 24 with folded edges down between pressure plate 28 and tumble shaft 23. The most suitable notch of the set of three notches 102 on each wheel 22 is positioned proximate the bottom edge of the stack of newspapers by retraction of rod 70 from slot 66 and rotation of the tumble shaft 23 until the appropriate slot 66, which places the desired notch adjacent the newspapers, is aligned with rod 70. Rod 70 is then released and allowed to enter the aligned slot 66, thereby locking plate 60 and tumble shaft 23 to cam 34.

When a suitable coin is inserted into the coin release mechanism 16 attached to the side of the unit, latch 100 (see FIG. 5) is released so that upon manual depression of handle 88, link rod 80 is moved towards cam 34. Movement of rod 80 towards cam 34 causes driving gear 76 to rotate clockwise thereby driving gear 74 and cam 34 counterclockwise. Counterclockwise rotation of cam 34 causes wheel 39 of follower 38 to move downwardly along shaped peripheral portion 43 of cam 34. The cam shape is such that wheels 22 move the leading newspaper upwardly, slightly in advance of upward movement of friction strips 26.

During initial travel of cam 34, notched wheels 22 initiate lifting of the foremost newspaper which becomes lodged in the corresponding notches 102 of wheels 22 due to pressure of pressure plate 28. As cam 34 continues to rotate, follower 38 begins to rotate clockwise causing rocker shaft 32 to rotate and lift friction strips 26 upwardly and slightly rearwardly thereby removing pressure from the stack of newspapers against the leading newspaper. Rollers 37 also assist in not only constraining the leading newspaper from folding frontwardly but in reducing friction as it is lifted below that which would result from a non-rotatable guide.

Once tumble shaft 23 has rotated sufficiently to carry the folded edge of the leading newspaper over the top of wheels 22, the newspaper drops into a catch 20 externally of the housing 12. The handle is then returned by a spring (not shown) placing the machine in a ready position for a repeat of the foregoing operation.

It will be obvious that rather than using separate notched wheels, a single notched wheel or drum may be employed. Also, the cam 34, follower 38, lugs 36 and rods 44 could be replaced by a gear attached to the rocker shaft and a pair of cam lifters rigidly affixed to the rocker shaft 32 to lift the friction strips 26. Also, there could be a short pin 103, 105 and 107 projecting out from each notch 102, 104 and 106, respectively to enhance the grip of each such notch on the folded edge of the leading newspaper.

Additionally, it will be obvious that the machine is equally applicable to dispensing magazines and other like materials as it is to newspapers.

It will also be obvious that the wheels could be cut out between the notches and need not have a continuous circular periphery. Clearly there could also be any number of sets of corresponding notches desired. Other systems of guiding plate 28 could be designed such as a pair of linear bushings affixed to either side of plate 28 each riding on corresponding ones of a pair of elongated rods.

Other variations, modifications and departures lying within the spirit of the invention and the scope as defined by the appended claims will be obvious to those skilled in the art.

What is claimed is:

1. A newspaper dispensing machine comprising:

(a) a frame;

(b) slide means mounted on said frame for supporting a vertically orientated stack of newspapers whose folded edges face downwardly, said slide means having a discharge end;

(c) pressure plate means mounted on said frame for biasing the vertically orientated stack of newspapers towards the discharge end of said slide means;

(d) a discharge chute located proximate the discharge end of said slide means;

(e) transporting means mounted on said frame proximate the discharge end of said slide means having lip means for engaging a folded edge of a leading newspaper in the stack of newspapers at the discharge end of said slide means;

(f) friction belt means mounted on said frame having an upper newspaper contacting surface with a high coefficient of friction with paper and reversibly movable from a retracted position spaced apart from the folded edges of the stack of newspapers to an extended position abutting the folded edges of the newspapers and slightly upwardly and rearwardly of the retracted position;

(g) moving means mounted on said frame and coupled to said friction belt means for reversibly moving the latter from the retracted position to the extended position and coupled to said transporting means such that said transporting means raises the leading newspaper above a notional plane defined by folded edges of the remaining newspapers in the stack, then said friction belt means moves from the retracted position to the extended position raising the remaining newspapers in the stack and moving them away slightly from the leading newspaper to relieve pressure on the leading newspaper and then said moving means moves the leading newspaper to and discharges it into said discharge chute.

2. A newspaper dispensing machine as defined by claim 1 wherein said transporting means includes rotating means having a notch parallel to said stack for engaging a bottom edge of the leading newspaper and rotatable so as to move the leading newspaper to and release it into said discharge chute.

3. A newspaper dispensing machine as defined by claim 1 wherein said pressure plate means includes;

(a) a pressure plate oriented substantially vertically;

(b) a pair of carriages each having wheels, rollable along respective inclined rails on each side of said frame;

(c) means for affixing said plate to each of said carriages; and (d) spring means for biasing said carriages downwardly toward said transporting means.

4. A newspaper dispensing machine as defined by claim 1 further comprising linkage means coupled to said rotating means for effecting manual rotation thereof.

5. A newspaper dispensing machine as defined by claim 2 wherein said moving means includes a rotatable rocker shaft and said rotating means includes rocker shaft coupling means such that said rocker shaft rotates in response to rotation of said rotating means.

6. A newspaper dispensing machine as defined by claim 2 wherein said moving means includes a rocker shaft rotatably mounted on said frame parallel to said rotating means, lugs affixed to said rocker shaft and journalled to said friction belt means, a rocker arm affixed to said rocker shaft and a cam affixed to said rotating means for driving said rocker arm such that rotation of said rocker arm causes said lugs to rotate so as to move said friction belt means upwardly and rearwardly with respect to said slides and rotation of said rocker shaft is sufficiently retarded relative to rotation of said rotating means so that the bottom edge of the leading newspaper is not contacted by said friction belt means.

7. A newspaper dispensing machine as defined by claim 2 wherein said pressure plate means includes;

(a) a pressure plate oriented substantially vertically;

(b) a pair of carriages each having wheels, rollable along respective inclined rails on each side of said frame;

(c) means for affixing said plate to each of said carriages; and (d) spring means for biasing said carriages downwardly toward said transporting means.

8. A newspaper dispensing machine as defined by claim 2 wherein said transporting means includes a wheel rotatable about its axis and having a plurality of spaced apart notches parallel to said axis each notch being of a different thickness so as to accommodate different thicknesses of newspapers in said stack and said machine further includes adjustment means for selectively positioning each of said notches into an operating position adjacent the bottom edge of the leading newspaper in said stack.

9. A newspaper dispensing machine as defined by claim 8 wherein each of said notches has a seat for receiving a folded edge of the leading newspaper which seat is substantially radially disposed with respect to said wheel and a back substantially perpendicular to said seat.

10. A newspaper dispensing machine as defined by claim 9 wherein said moving means includes a rotatable rocker shaft and said rotating means includes rocker shaft coupling means such that said rocker shaft rotates in response to rotation of said rotating means.

11. A newspaper dispensing machine as defined by claim 9, wherein said friction belt means includes an elongated channel and a plurality of friction strips mounted on the back of associated channels and wherein said moving means includes a rocker shaft rotatably mounted on said frame parallel to said rotating means, lugs affixed to said rocker shaft and journalled to said channels, a rocker arm affixed to said rocker shaft and a cam affixed to said rotating means for driving said rocker arm such that rotation of said rocker arm causes said lugs to rotate so as to move said channels upwardly and rearwardly with respect to said slides and rotation of said rocker shaft is sufficiently retarded relative to rotation of said rotating means so that the bottom of the leading newspaper is not contacted by said friction strips.

12. A newspaper dispensing machine as defined by claim 9 further comprising linkage means coupled to said rotating means for effecting manual rotation thereof.

13. A newspaper dispensing machine as defined by claim 9 wherein said pressure plate means includes;

(a) a pressure plate oriented substantially vertically;

(b) a pair of carriages each having wheels, rollable along respective inclined rails on each side of said frame;

(c) means for affixing said plate to each of said carriages; and (d) spring means for biasing said carriages downwardly toward said transporting means.

14. A newspaper dispensing machine as defined by claim 9 wherein each of said notches has a seat for receiving a folded edge of the leading newspaper which seat is substantially radially disposed with respect to said wheel and a back substantially perpendicular to said seat.

15. A newspaper dispensing machine as defined by claim 2 wherein said transporting means includes a plurality of spaced apart wheels mounted on a tumble shaft and having a plurality of aligned notches such that each notch in a set of aligned notches has the same depth but the depth of the notches in different sets of aligned notches varies to accomodate different thicknesses of newspapers in said stack and said machine further includes adjustment means for selectively positioning each set of aligned notches into an operating position adjacent the bottom edge of the leading newspaper in said stack.

16. A newspaper dispensing machine as defined by claim 15 wherein said moving means includes a rotatable rocker shaft and said rotating means includes rocker shaft coupling means such that said rocker shaft rotates in response to rotation of said rotation means.

17. A newspaper dispensing machine as defined by claim 15 wherein said moving means includes a rocker shaft rotatably mounted on said frame parallel to said rotating means, lugs affixed to said rocker shaft and journalled to said friction belt means, a rocker arm affixed to said rocker shaft and a cam affixed to said rotating means for driving said rocker arm such that rotation of said rocker arm causes said lugs to rotate so as to move said friction belt means upwardly and rearwardly with respect to said slides and rotation of said rocker shaft is sufficiently retarded relative to rotation of said rotating means so that the bottom edge of the leading newspaper is not contacted by said friction belt means.

18. A newspaper dispensing machine as defined by claim 15 further comprising linkage means coupled to said rotating means for effecting manual rotation.

19. A newspaper dispensing machine as defined by claim 15 wherein each of said notches has a seat for receiving a folded edge of the leading newspaper which seat is substantially radially disposed with respect to said wheel and a back substantially perpendicular to said seat.

20. A newspaper dispensing machine as defined by claim 1 wherein said slides are ethylene tetrafluoride.

* * * * *